United States Patent [19]

Myotte

[11] 3,987,655

[45] Oct. 26, 1976

[54] METHOD OF CONTINUOUSLY TRANSFORMING SOLID NON-FERROUS METAL INTO ELONGATED EXTRUDED SHAPES

[76] Inventor: Robert J. Myotte, 2250 Par Lane, Apt. PH6, Willoughby Hills, Ohio 44094

[22] Filed: Nov. 10, 1975

[21] Appl. No.: 630,086

[52] U.S. Cl. ..... 72/60; 72/264; 72/270

[51] Int. Cl.[2] ..... B21C 33/00; B21C 29/02

[58] Field of Search ..... 164/274, 281, 80; 72/270, 264, 60

[56] References Cited

UNITED STATES PATENTS

| | | | |
|---|---|---|---|
| 1,808,370 | 6/1931 | Munson | 164/274 |
| 1,924,294 | 8/1933 | Shirk et al. | 72/270 X |
| 2,454,961 | 11/1948 | Booth | 164/281 X |

FOREIGN PATENTS OR APPLICATIONS

| | | | |
|---|---|---|---|
| 2,079,458 | 11/1971 | France | 164/281 |
| 805,617 | 12/1958 | United Kingdom | 72/270 |
| 114,968 | 3/1962 | U.S.S.R. | 164/281 |

*Primary Examiner*—Robert D. Baldwin
*Attorney, Agent, or Firm*—Meyer, Tilberry & Body

[57] ABSTRACT

A method and apparatus for continuously extruding non-ferrous metal is shown and described wherein solid metal, such as bar stock, is fed into an entry port of an entirely enclosed melting crucible until the crucible is full of molten metal. A seal is maintained between the metal being fed and the entry port to establish pressure in the crucible and to prevent leakage back through the entry port. When the crucible is full, means are provided to re-solidify the molten metal adjacent a closed exit port. Thereupon, the exit port is opened and the re-solidified metal is extruded through the exit port at the same volumetric rate as metal is fed through the entry port.

10 Claims, 2 Drawing Figures

METHOD OF CONTINUOUSLY TRANSFORMING SOLID NON-FERROUS METAL INTO ELONGATED EXTRUDED SHAPES

This invention relates to a method for continuously extruding non-ferrous metal which eliminates the need for several traditional steps followed in conventional extruding processes, which permits the manufacture of unlimited lengths of extruded products, which utilizes extruding equipment that is less complex and therefore less expensive, and which is better suited to extrude smaller and more intricate shapes.

The customary prior art procedure to produce a non-ferrous metal extruded product comprises melting the metal; casting the metal into a billet; cooling the billet; cutting the billet into lengths suitable for extrusion; re-heating the pre-cut lengths to extrusion temperature; and extruding each pre-cut length in an extruding press.

It is an object of my invention to eliminate in the extruding art the steps of melting the metal; casting the metal into a billet; cooling the billet; cutting the billet into lengths suitable for extruding; and re-heating the billet to extrusion temperature. It is another object of my invention to eliminate the need for a comparatively large and expensive extruding press; it is still a further object of this invention to provide method and apparatus for extruding non-ferrous metals on a continuous basis to provide extrusions of unlimited length which method and apparatus are simple, inexpensive, and more efficient than prior art method and apparatus for producing the same product. It is a still further object of my invention to provide a method and apparatus for providing extruded products of unlimited length which may be smaller and more intricate than shapes presently obtainable with known prior art methods.

Other objects, features and advantages of the present invention will become more apparent in light of the following detailed description of the preferred embodiments hereof, as illustrated in the accompanying drawings.

Figure 1:
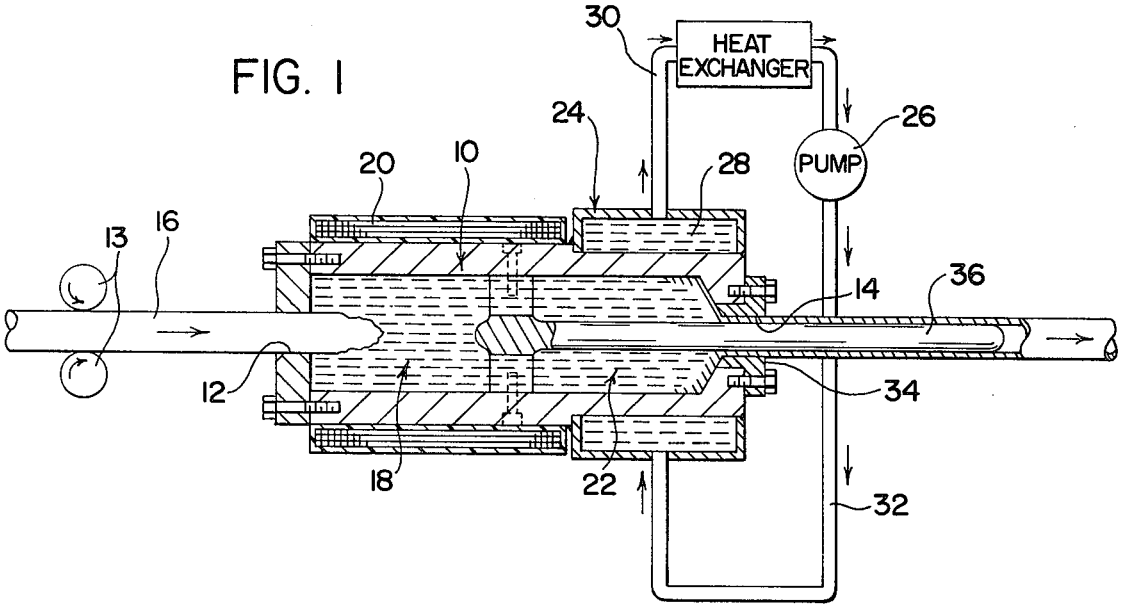
FIG. 1 is a schematic full sectional showing of a preferred embodiment of the invention in which bar stock, or the like, is utilized as a source of material for conversion into an extruded product.

Referring now to the drawings in greater detail, a crucible 10 is shown which is entirely enclosed with the exception of an entry port 12 and a closeable exit port 14. The exit port may be closed with any conventional means such as a ceramic dam or the like, which may be knocked out when the aparatus is ready to extrude. Solid metal 16, such as bar stock or rod of any cross sectional shape, but preferably round, is fed into entry port 12 by means of feed rolls 13. The entry port is of slightly smaller diameter than the bar stock so as to provide sufficient interference between the entry port and the stock that an effective seal is maintained therebetween. Zone 18 of the crucible 10 is heated by any conventional means 20, such as by gas, oil, or electricity, sufficient to melt the bar stock at the same rate at which it is fed into the crucible. Zone 22 adjacent the exit port 14 is provided with cooling means which may be a heat exchanger jacket 24 adapted to re-circulate by pump means 26 a fluid 28 about crucible 10 and through re-circulating conduits 30 and 32. Heat exchanger jacket 24 has capacity to cool the molten metal in this zone sufficiently to re-solidify the metal and to continue cooling the metal down to extruding temperature. A heat exchanger of the type shown schematically in FIG. 1 is well known in the art and further explanation of its operation therefore is dispensed with.

To start up the operation, the exit port 14 is stopped and zone 18 of the crucible is preheated to a temperature, in a preferred embodiment, sufficient to melt the bar stock 16 at the predetermined rate at which the bar stock is to be fed into the crucible.

The term melting as used herein and in the claims is to be understood to encompass the heating of the metal at least to a temperature wherein the metal assumes most, if not all, of the physical properties of a liquid. For instance, the body of metal must be in a sufficiently fluid-like state so as to be capable of transmitting hydrostatic pressure to create the flow of metal around the forming mandrel free of seams and the like. Otherwise stated, the term melting is not limited solely to heating the metal to such an elevated temperature wherein the entire body of metal is in the pure molten liquid state, i.e., the known melting temperature of the metal, but also includes heating to the above described temperature at which the metal at least is flowable, said temperature being generally a lower temperature than the known melting temperature.

Bar stock 16 is then fed into entry port 12 and continuously melted. When the crucible 10 has been completely filled with molten metal, the heat exchanger 24 is actuated to re-solidify the molten metal in zone 22 adjacent the exit port 14. When the molten metal has been re-solidified and reduced to the extruding temperature of this metal the exit port 14 is then un-stopped and the re-solidified metal is extruded through the exit port at the same volumetric rate at which the original solid metal is fed through the entry port 12. Any extruded shape may be obtained by use of a suitable extruding die 34 secured in the exit port. If seamless tubing is to be extruded, a mandrel 36 may be mounted in the crucible concentric with the exit port, wherein the re-solidified metal surrounding the mandrel 36 will be extruded through the exit port 14 in seamless tubular form.

Figure 2:
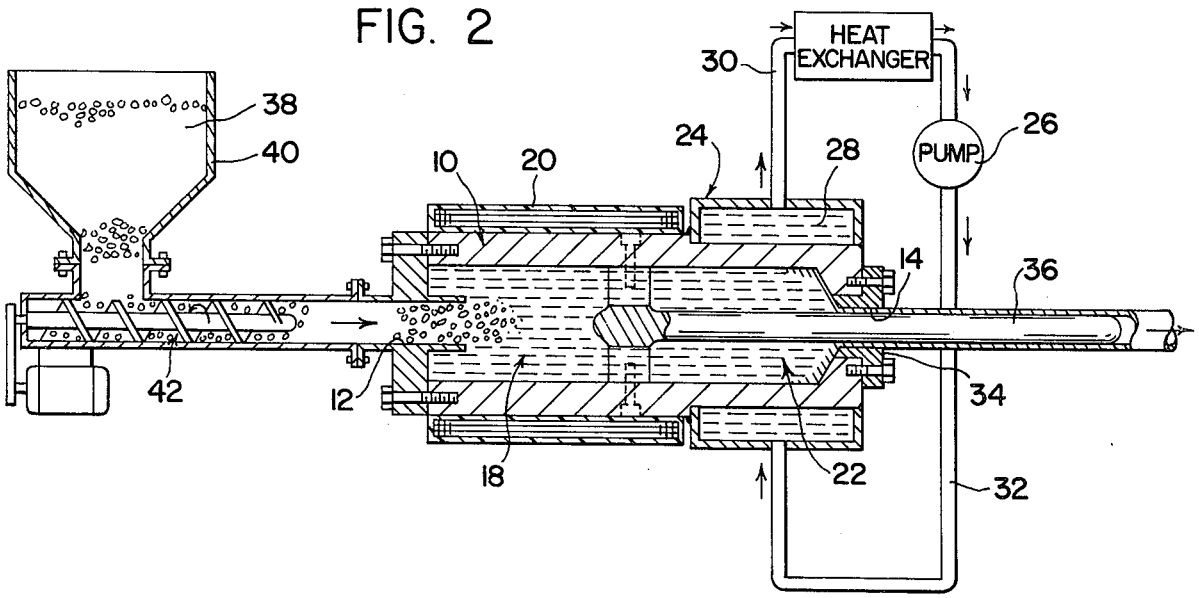
FIG. 2 is another preferred embodiment of the invention shown in full section wherein granular metallic materials are converted into an extruded product.

In the embodiment shown in FIG. 2, in lieu of the bar stock employed in FIG. 1, granular non-ferrous metal 38, such as powdered metal, may be employed wherein it is fed into a hopper 40 and transported by means of a screw conveyor 42 through the entry port 12, wherein the operation thereafter is the same as described with respect to FIG. 1.

Having thus described typical embodiments of my invention that which I claim as new and desire to secure by Letters Patent is:

1. The method of continuously transforming solid non-ferrous metal into elongated extruded shapes in an enclosed crucible having an entry port and an exit port remote from said entry port comprising the steps of:

a. feeding said solid metal through said entry port into the interior of said crucible;

b. melting said solid metal as it enters said crucible until said crucible is filled;

c. continuing to feed said solid metal into said crucible to apply hydrostatic pressure to said melted metal;

d. continuing to melt said solid metal as it enters said crucible;

e. cooling the portion of said melted metal adjacent said exit port until said melted metal re-solidifies;

f. continuing to cool said re-solidifed metal to extruding temperature;

g. continuing to apply hydrostatic pressure to said metal within said crucible by continuing to feed said solid metal through said entry port whereby said re-solidified metal is extruded through said exit port.

2. The method of claim 1, wherein said solid metal is fed through said entry port at the same volumetric rate as re-solidified metal is extruded from said exit port.

3. The method of claim 1, including the step of extruding said re-solidified metal through a die positioned adjacent said exit port.

4. The method of claim 1, including the step of extruding said re-solidified metal about a mandrel positioned adjacent said exit port.

5. The method of claim 1, including the step of extruding said re-solidified metal between a die and mandrel positioned adjacent said exit port.

6. The method of claim 1, wherein said solid metal is bar stock.

7. The method of claim 1, wherein said solid metal is granular.

8. The method of claim 1, wherein said solid metal is pelletized.

9. The method of claim 1, wherein said solid metal is powdered.

10. The method of claim 1, wherein said solid metal is fed through said entry port in pressure sealed relationship therebetween.

* * * * *